US007296763B2

(12) United States Patent
Bliss et al.

(10) Patent No.: US 7,296,763 B2
(45) Date of Patent: Nov. 20, 2007

(54) KEYLESS FRICTIONAL SHAFT/HUB LOCKING DEVICE

(75) Inventors: Theron J. Bliss, Granville, MA (US); Jeffrey A. Case, East Granby, CT (US); Robert R. Tobiasz, Suffield, CT (US)

(73) Assignee: ALSTOM Technology Ltd (CH)

( * ) Notice: Subject to any disclaimer, the term of this patent is extended or adjusted under 35 U.S.C. 154(b) by 211 days.

(21) Appl. No.: 11/119,941

(22) Filed: May 3, 2005

(65) Prior Publication Data

US 2006/0249610 A1 Nov. 9, 2006

(51) Int. Cl.
*B02C 18/16* (2006.01)

(52) U.S. Cl. ..... 241/293; 29/895.1; 29/895.21

(58) Field of Classification Search ..... 241/101.2, 241/293, 294, 295, 236; 29/895.1, 895.21
See application file for complete search history.

(56) References Cited

U.S. PATENT DOCUMENTS 2,097,982 A * 11/1937 Kist et al. ..... 403/272
2,651,241 A * 9/1953 Hornbostel ..... 29/895.21
3,501,183 A * 3/1970 Stratienko ..... 403/370
3,752,004 A * 8/1973 Hanssen ..... 74/443

* cited by examiner

*Primary Examiner*—Mark Rosenbaum
(74) *Attorney, Agent, or Firm*—Antonelli, Terry, Stout & Kraus

(57) ABSTRACT

A grinder roll assembly (500) is provided herein. The grinder roll assembly (500) includes a grinder roll (505), a shaft (510) in a through bore of the grinder roll, a first tapered sleeve (615A), and a second tapered sleeve (615B). The first tapered sleeve (615A) fits between the shaft (510) and the grinder roll (505) in one direction, and the second tapered sleeve (615B) fits between the shaft (510) and the grinder roll (505) in an opposite direction to form at least one friction lock that mounts the grinder roll (505) to the shaft (510).

18 Claims, 8 Drawing Sheets

KEYLESS FRICTIONAL SHAFT/HUB LOCKING DEVICE

FIELD OF THE INVENTION

The present invention is related to clinker grinders, and more particularly to an improved technique for attaching a grinder roll to a shaft.

BACKGROUND OF THE INVENTION

FIG. 1 shows a portion of a typical coal-burning utility electrical power generation plant 20. Coal is loaded into hopper 22 and gravity fed as shown at arrow 24 to inlet duct 26 of ball tube mill 28. The mill includes a rotary drum with a charge or plurality of balls therein which pulverize the coal as the drum rotates to produce pulverized coal. The pulverized coal is discharged as shown at arrow 34 to outlet duct 36 for introduction to the burner of boiler 38. Incoming combustion air is supplied as shown at arrow 40 from fan 42. The heat of combustion of the air and pulverized coal is supplied as shown at arrow 44 through a plurality of heat exchangers 46, 48, to generate steam to in turn drive electrical power generating turbines, as is standard. After giving up heat for the noted steam generation, exhaust including fly ash flows as shown at arrow 50 to exhaust outlet 52. An air preheater 54 is connected between combustion air inlet duct 56 and exhaust outlet duct 58 for transferring heat from the exhaust flow at 50 to the incoming combustion air flow at 40 to pre-heat the latter. The spent pulverized coal, after ignition and burning, fuses as hardened chunks called bottom ash clinkers, and are collected and ground at clinker grinder 60 for discharge and disposal. Of course, as will be understood by one of ordinary skill in the art, clinkers are also produced by other type coal-fired furnaces, beyond that depicted in FIG. 1.

A typical clinker grinder 60 includes two grinder roll assemblies that intermesh with knurls to grind the bottom ash clinkers. FIG. 2 depicts a conventional and well known grinder roll assembly 200. Included in assembly 200 is a cast Ni-hard grinding roll 205 that is mounted on a stainless steel shaft 210. As shown, the Ni-hard grinding roll 205 has multiple knurls, though for simplicity's sake only a single knurl is labeled 220, formed on the outer surface thereof. The Ni-hard grinding roll 205 cannot be directly welded to the stainless steel shaft 210 because of differences in material properties. In lieu of welding, pentagonal shaped insert 225 is used to mount the grinding roll 205 to the stainless steel shaft 210, as shown in FIG. 3. Insert 225 is hand fitted into the bore of the Ni-hard grinding roll 205. As shown in FIG. 4, the insert 225 is then welded to the stainless steel shaft 210.

A clinker grinder 60 is subject to extensive wear. In addition to wear to the knurls and other parts of the Ni-hard grinding roll 205, there is frequent failure of the weld between the insert 225 and the shaft 210. Also, it is known for insert 225 to fail and spin within the Ni-hard grinding roll 205. Because of the use of insert 225, both the Ni-hard grinding roll 205 and the stainless steel shaft 210 must be replaced together, even if only the Ni-hard grinding roll 205 is worn. That is, the welding of the insert 225 to the stainless steel shaft 210 causes stress concentrations to the shaft 210 that make it undesirable to reuse the stainless steel shaft 210.

The forced replacement of stainless steel shaft 210 is not economical, as each stainless steel shaft 210 costs approximately $1,200.00. Also, labor costs associated with machining the bore of the Ni-hard grinding roll 205 and the shaft 210 for fitting to the insert 225, and with the actual mounting of the Ni-hard grinding roll 205 on the shaft 210, are high. Furthermore, the mounting procedure itself is prone to crack the Ni-hard grinding roll 205, making it unusable.

Accordingly, a need exists for a grinder roll assembly which overcomes deficiencies of existing grinder roll assemblies. Thus, a need exists for a grinder roll assembly with an improved way of mounting a grinding roll to a shaft. A need also exists for a grinder roll assembly in which a welded insert is not required to mount the grinding roll to the shaft. A need also exists for a grinder roll assembly in which it is only necessary to replace worn parts. Also, a need exists for a grinder roll assembly which can be rebuilt using a previously used shaft, as well as a grinder roll assembly which is not subject to cracking during assembly. And, a need also exists for a grinder roll assembly which is economical to assemble.

OBJECTS OF THE INVENTION

It is an object of the present invention to provide a grinder roll assembly that overcomes the deficiencies of existing grinder roll assemblies.

It is also an object of the present invention to provide a grinder roll assembly which includes an improved way of mounting the grinding roll to the shaft.

It is yet another object of the present invention to provide a grinder roll assembly in which a welded insert is not required to mount the grinding roll to the shaft.

Still another object of the present invention is to provide a grinder roll assembly in which it is only necessary to replace worn parts.

Yet another object of the present invention is to provide a grinder roll assembly having a shaft that can be reused.

Another object of the present invention is to provide a grinder roll assembly that is not subject to cracking during assembly.

It is still another object of the present invention to provide a grinder roll assembly that is economical to assemble.

The above-stated objects, as well as other objects, features, and advantages, of the present invention will become readily apparent from the following detailed description which is to be read in conjunction with the appended drawings.

SUMMARY OF THE INVENTION

A grinder roll assembly, a locking mechanism for a grinder roll, and a method for locking a grinder roll and a shaft are provided. The grinder roll assembly includes a grinder roll, such as, but not limited to, a Ni-hard grinder roll, that has a through bore that extends from one end of the roll to the other, a shaft is disposed within the through bore, and first and second tapered sleeves.

The first tapered sleeve fits over the shaft and into the grinder roll bore such that a first end of this first tapered sleeve is positioned nearer to a first end of the bore. This first end of the first tapered sleeve is narrower than a second end of the first tapered sleeve. In other words, the first tapered sleeve is inserted into the bore thick end first.

The second tapered sleeve also fits over the shaft and into the grinder roll bore. However, the second tapered sleeve is inserted into the bore with the thin end of the second tapered sleeve inserted first so as to fit against the first tapered sleeve to form multiple friction locks which prevent movement. A first friction lock is between the first and second tapered sleeves, a second friction lock is between the one tapered sleeve and the grinder roll, i.e., the inside of the bore, and a third friction lock is between the other tapered sleeve and the shaft. Because of these friction locks, the grinder roll and the shaft become interconnected.

In one aspect, the grinder roll assembly is for use in a clinker grinder that is associated with a coal-fired furnace. The clinker grinder pulverizes the clinkers, which are produced as a byproduct of burning coal, into smaller particles.

According to another aspect, the grinder roll assembly also includes a locking ring that fits over the shaft and is in contact with the second tapered sleeve. When installed the locking ring causes the second tapered sleeve to draw against the first tapered sleeve. Still further, the grinder roll assembly also includes at least one connector, such as, but not limited to, a bolt, for securing the locking ring to the grinder roll. In a still further aspect, the grinder roll assembly also includes at least one connection for securing the locking ring to either or both of the first tapered sleeve and the second tapered sleeve.

In yet another aspect, the grinder roll assembly also includes a third tapered sleeve and a fourth tapered sleeve. The third tapered sleeve fits over the shaft and into the grinder roll bore such that a first end of the third tapered sleeve is nearer to a second end of the bore. Similar to the first tapered sleeve, the first end of the third tapered sleeve is narrower than a second end of the third tapered sleeve, i.e., the thick end of the third tapered sleeve is inserted into the bore first.

The fourth tapered sleeve also fits over the shaft and into the grinder roll bore such that a fourth friction lock between the third tapered sleeve and the fourth tapered sleeve, a fifth friction lock between the grinder roll and one of the third tapered sleeve and the fourth tapered sleeve, and a sixth friction lock between the shaft and the other one of the third tapered sleeve and the fourth tapered sleeve, are formed.

In a further aspect, the grinder roll assembly includes another locking ring that fits over the shaft and is in contact with the fourth tapered sleeve, causing the fourth tapered sleeve to draw against the third tapered sleeve. Still further, at least one connector may be utilized to secure the second locking ring to at least one of grinder roll, the third tapered sleeve, and the fourth tapered sleeve.

The locking mechanism for a grinder roll assembly disclosed herein includes a first tapered sleeve and a second tapered sleeve. The first tapered sleeve is adapted to fit between a grinder roll shaft and a grinder roll surface that defines a through bore such that a first end of the first tapered sleeve is positioned near to a first end of the through bore. Similar to the discussion above, the first end of the first tapered sleeve has a first thickness and a second end of the first tapered sleeve has a second thickness greater than the first thickness.

The second tapered sleeve is adapted to fit over the shaft and into the through bore such that a first friction lock between the first tapered sleeve and the second tapered sleeve, a second friction lock between the grinder roll and one of the first tapered sleeve and the second tapered sleeve, and a third friction lock between the shaft and the other one of the first tapered sleeve and the second tapered sleeve, are formed.

The method of the present invention for locking a grinder roll and a shaft will be understood with reference to the grinder roll assembly and locking mechanism described above.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT

Figure 1:
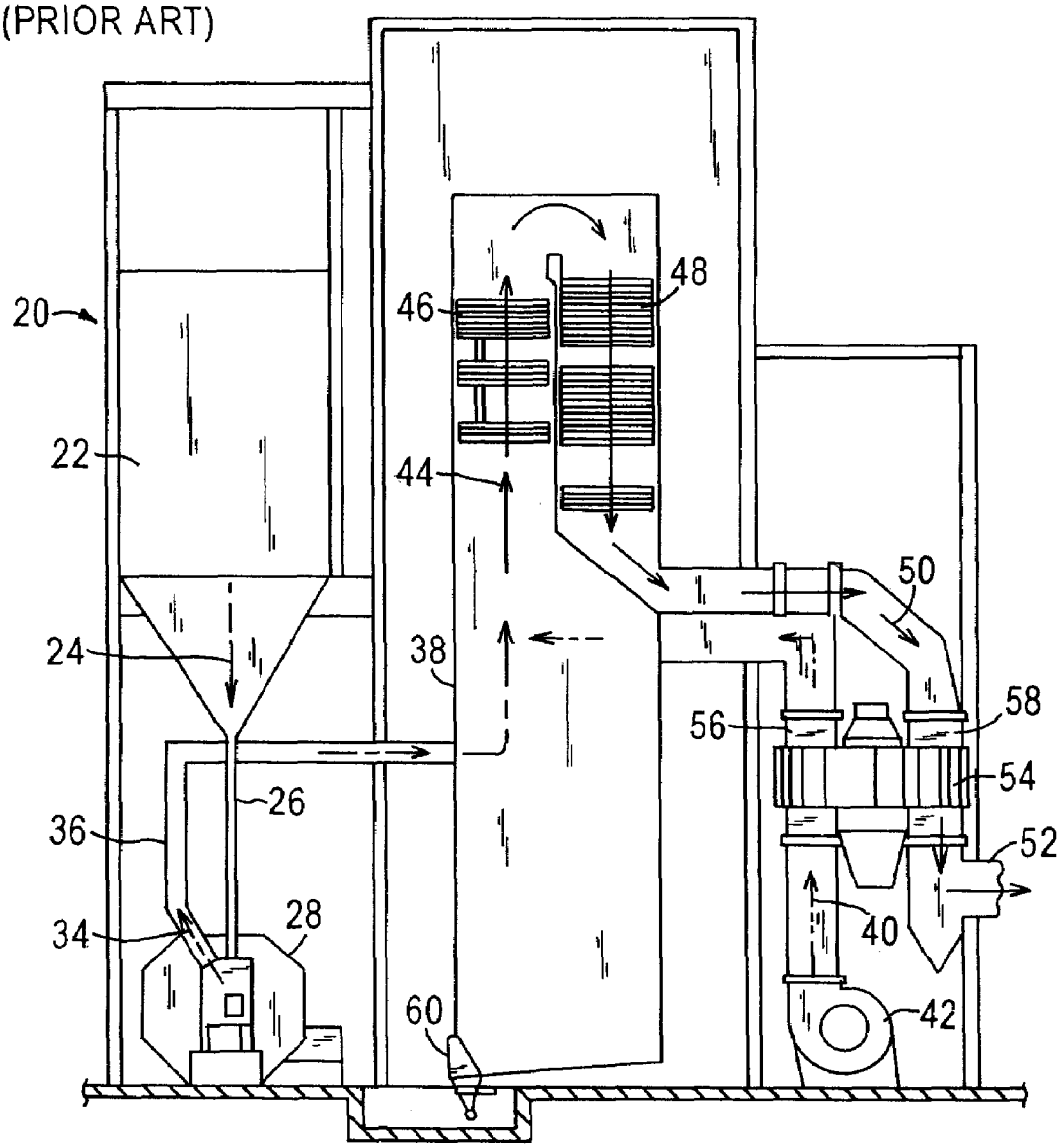
FIG. 1 (PRIOR ART)
FIG. 1 is a schematic illustration of a portion of a coal-burning utility electrical power generation plant, including a clinker grinder.
Figure 2:
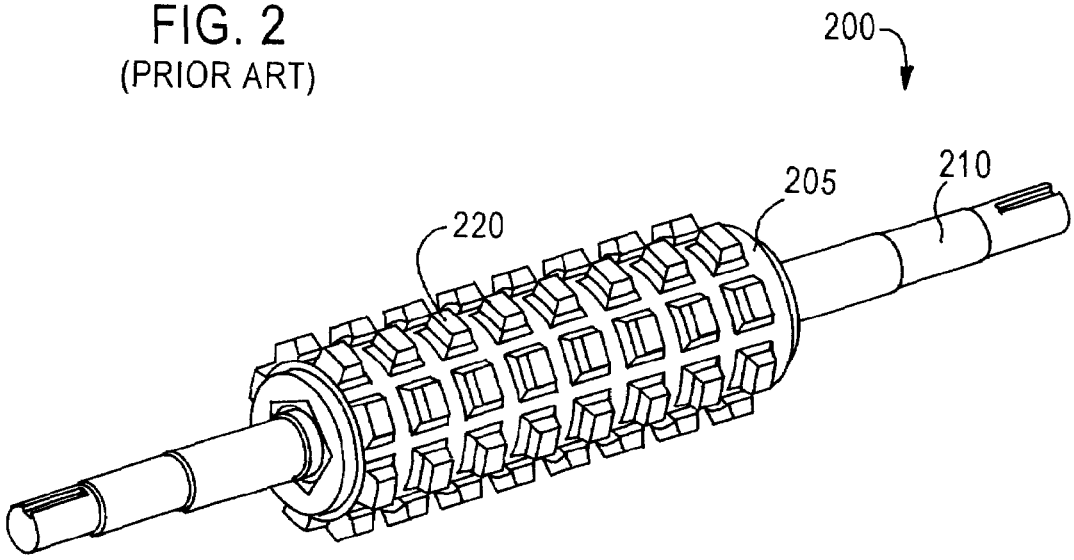
FIG. 2 (PRIOR ART)
FIG. 2 depicts a conventional grinder roll assembly for use in a clinker grinder depicted in FIG. 1.
Figure 3:
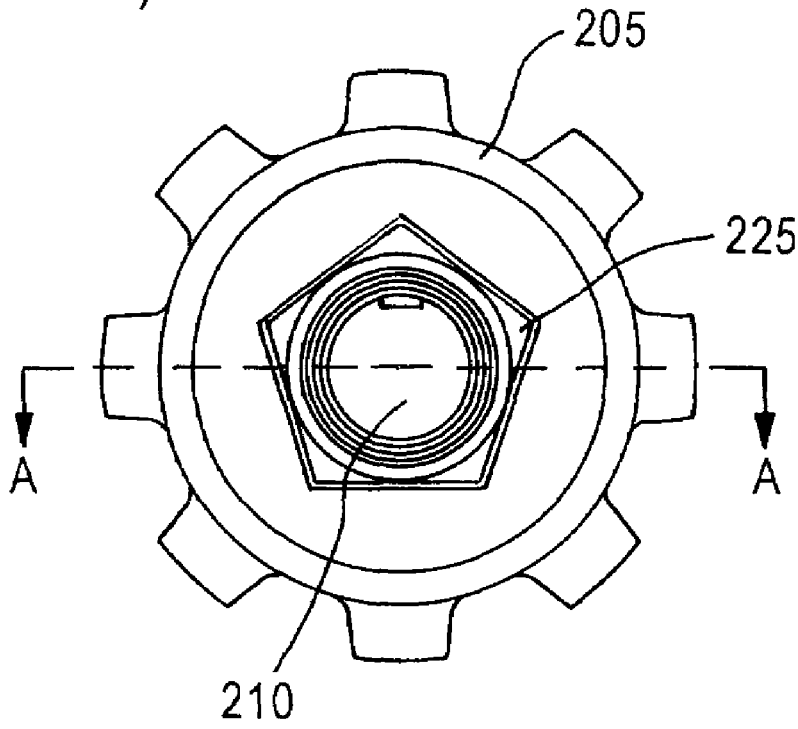
FIG. 3 (PRIOR ART)
FIG. 3 is another view of the grinder roll assembly of FIG. 2.
Figure 4:
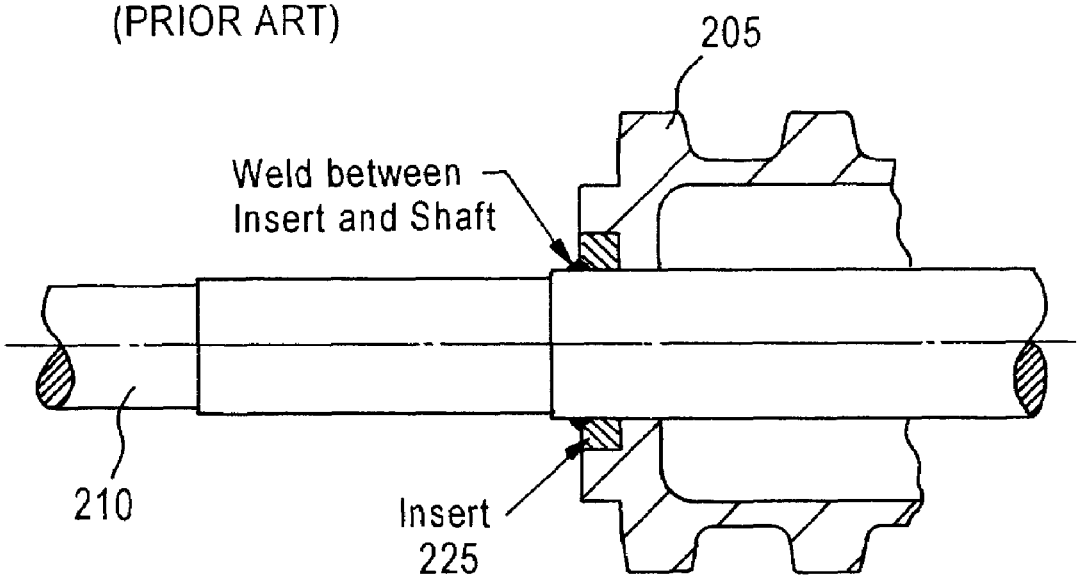
FIG. 4 (PRIOR ART)
FIG. 4 is yet another view of the grinder roll assembly of FIG. 2.
Figure 5:
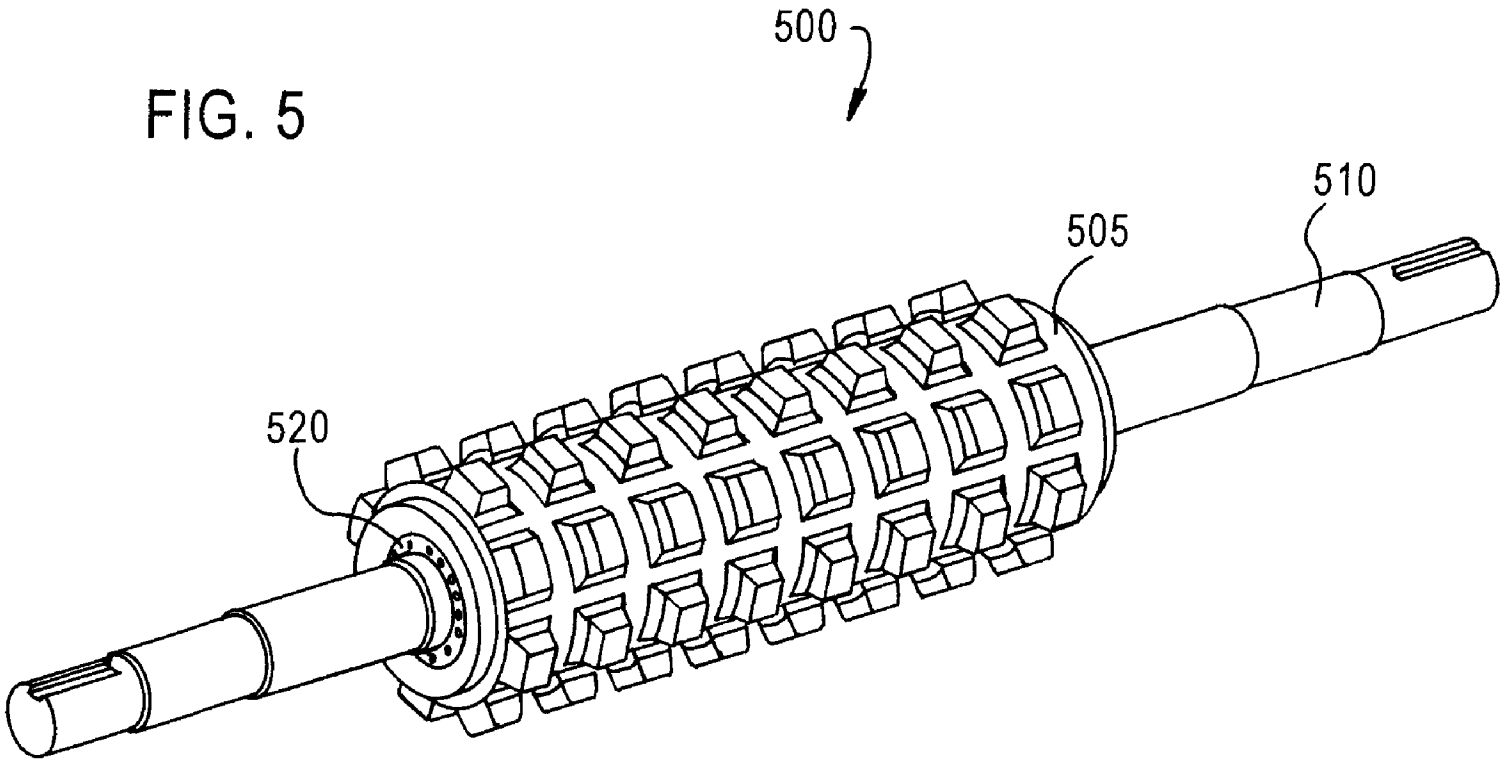
FIG. 5 is depicts a grinder roll assembly in accordance with certain aspects of the present invention.

FIG. 5 depicts a new and improved grinder roll assembly 500 in accordance with the present invention. Included in assembly 500 is a grinding roll 505 and shaft 510. Preferably, the grinding roll 505 is a Ni-hard grinding roll. However, other suitable materials, as desired, may be utilized for the grinding roll 505 without departing from the essence of the present invention. Also preferably, the shaft 510 is stainless steel shaft. However, as with the grinding roll 505, other suitable materials, as desired, may be utilized for the shaft 510 without departing from the essence of the present invention.

Figure 6:
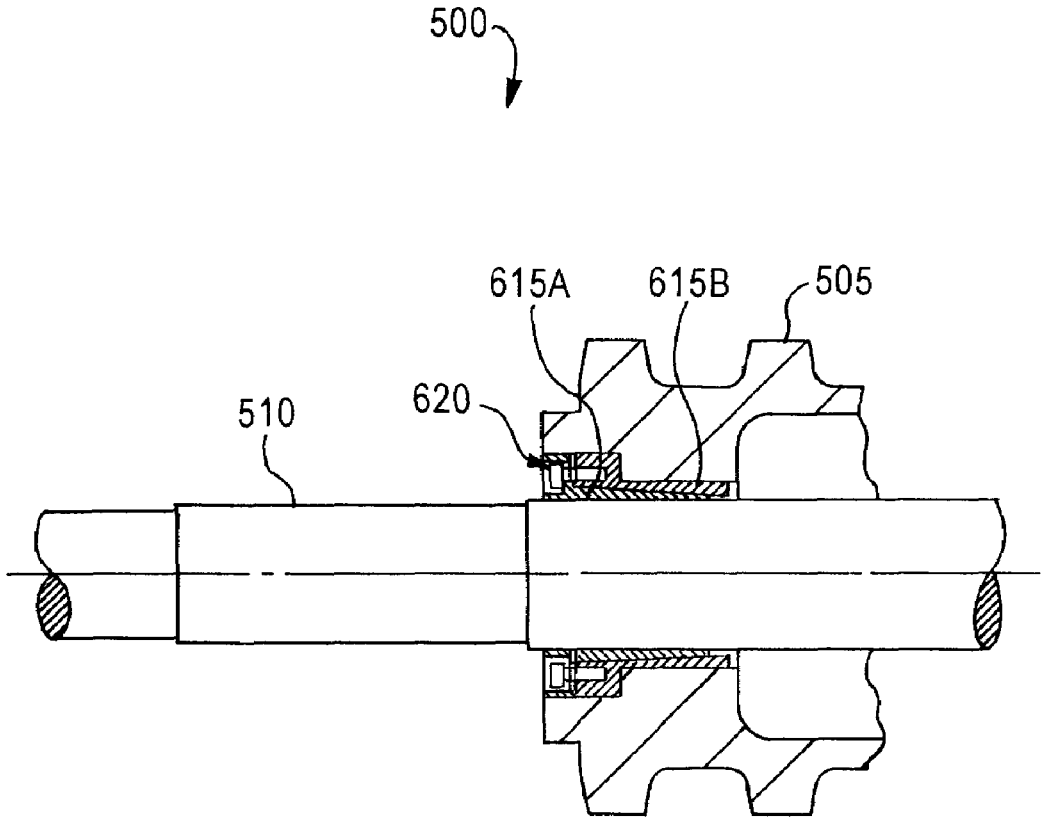
FIG. 6 is another view of the grinder roll assembly of FIG. 5.

The grinding roll 505 is mounted to the shaft 510 using a keyless frictional shaft/hub locking mechanism 520. Of course, it will be recognized by one of ordinary skill in the art that two keyless frictional shaft/hub locking mechanisms will be used to mount the grinding roll 505 to the shaft 510, one at either end of the grinding roll 505. A first tapered sleeve 615A and a second tapered sleeve 615B, with respective tapered ends facing opposite directions along the longitudinal axis of the shaft 510, are fitted into the bore of the grinding roll 505 and over the shaft 510, as shown in FIG. 6. The first tapered sleeve 615A and the second tapered sleeve 615B are fitted into the bore such that the first tapered sleeve 615A and the second tapered sleeve 615B overlap.

Figure 7:
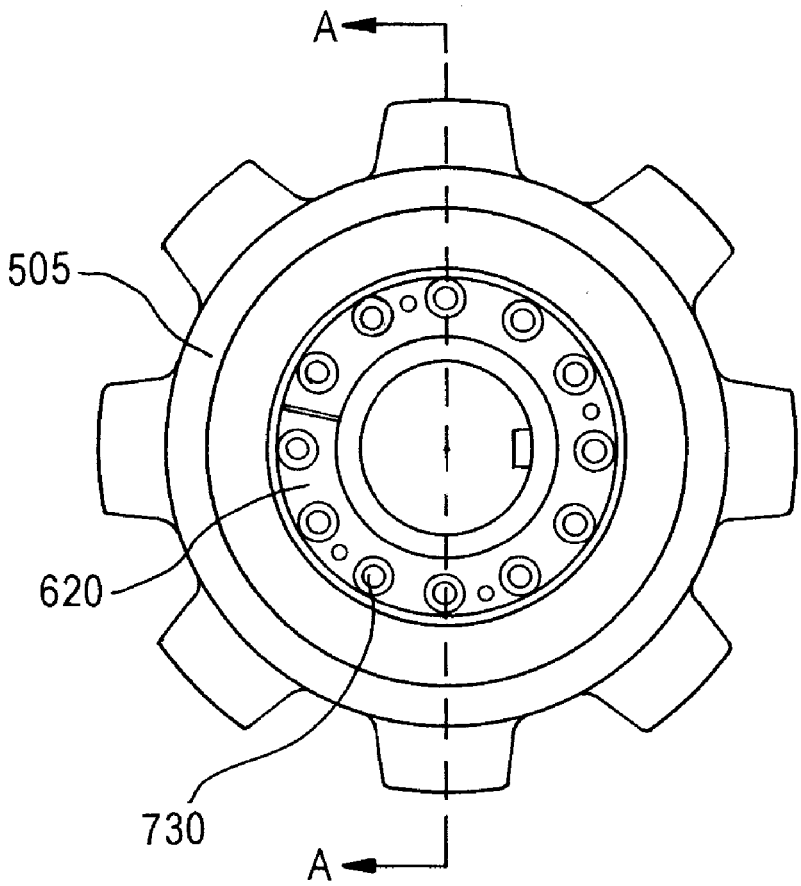
FIG. 7 is yet another view of the grinder roll assembly of FIG. 5.

The first tapered sleeve 615A and the second tapered sleeve 615B are drawn tight over one another by a locking hub 620. Preferably, though not necessarily, the locking hub 620 is affixed to, and perhaps a part of, the first tapered sleeve 615A. As shown in FIG. 7, the locking hub 620 is secured by tightening fasteners to draw the first tapered sleeve 615A and the second tapered sleeve 615B over one another. For simplicity's sake, only a single fastener is designated by the reference numeral 730 in FIG. 7. It should be understood, however, that while FIG. 7 depicts twelve fasteners, a greater number or a lesser number of fasteners, as desired, could be utilized without departing from the essence of the present invention.

Locking hub 620, as it is fastened, pushes the first tapered sleeve 615A and the second tapered sleeve 615B together. It should be understood that while FIG. 6 depicts the first tapered sleeve 615A being pushed underneath the second tapered sleeve 615B by the locking hub 620, if so desired, the first tapered sleeve 615A and the second tapered sleeve 615B can be placed onto shaft 510 in the opposite directions without departing from the essence of the present invention such that the second tapered sleeve 615B is pushed underneath the first tapered sleeve 615A by the locking hub 620.

Figure 8:
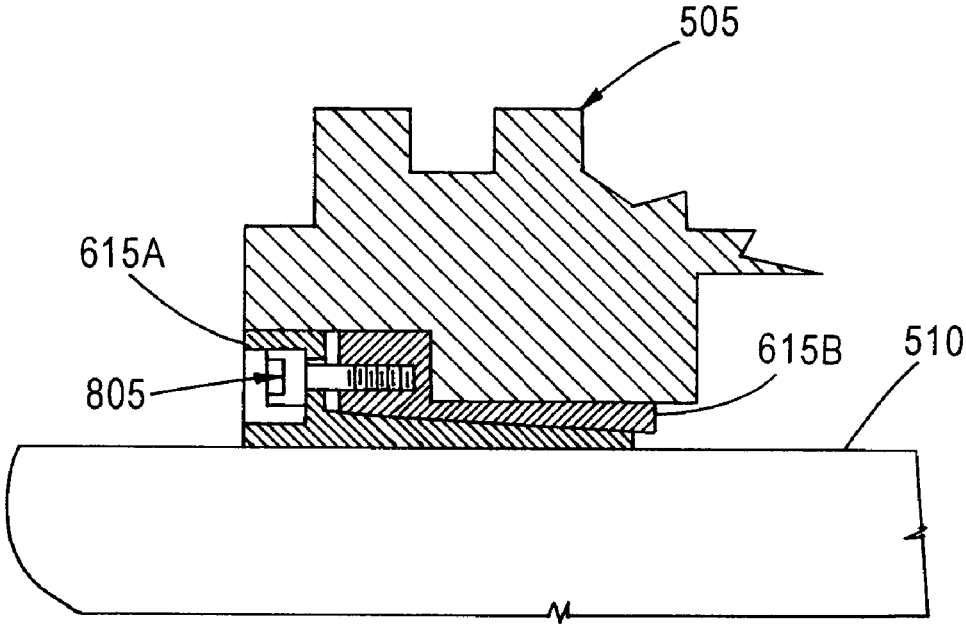
FIG. 8 is still another view of the grinder roll assembly of FIG. 5.

FIG. 8 is a further depiction of the locking hub 620, with a bolt 805 serving as a fastener. As will be understood from the above, preferably multiple bolts are utilized, though only a single bolt 805 is shown in FIG. 8. In the alternative depicted in FIG. 8 the bolt 805 itself does not tap into the grinding roll 505. Rather, the bolt 805 passes through the first tapered sleeve 615A and into a tapped hole on the second tapered sleeve 615B. By tightening on the bolt 805, the bolt 805 pulls the first tapered sleeve 615A and the second tapered sleeve 615B together. As the tapered sleeves slide over one another, the tapered sleeve closest to the shaft 510 (the inner tapered sleeve) exerts a pressure on the shaft 510 and the other tapered sleeve (the outer tapered sleeve) exerts a pressure on the grinder roll 505, locking the grinder roll 505 to the shaft 510. As the bolt 805 is further tightened, the tapered sleeves are further pulled up on each other, increasing the pressure.

No welding is required when mounting the grinding roll 505 to shaft 510 using the keyless frictional shaft/hub locking mechanism 520. To this end, the friction generated by the pressure of the first tapered sleeve 615A and the second tapered sleeve 615B pushing off of one another interlocks the shaft 510 to the grinding roll 505 such that when the shaft 510 rotates about its longitudinal axis the grinding roll 505 also rotates. Also the mounting of the grinding roll 505 to the shaft 510 using the keyless frictional shaft/hub locking mechanism requires less time to complete than is required with the prior art mounting approaches.

Mentioned above, the present invention does not require welding for purposes of mounting the grinding roll 505 to the shaft 510. Because of the lack of welding, the risk of failure of a weld is nonexistent in the present invention, and the possibility of a stress concentration occurring on the shaft 510 as a result of welding is also eliminated. Thus, because of the lack of welding, the locking hub 620 and the shaft 510 are capable of being reused in a rebuild, if so desired.

The present invention is not to be limited in scope by the specific embodiments described herein. Indeed, various modifications of the present invention in addition to those described herein will be apparent to those of skill in the art from the foregoing description and accompanying drawings. Thus, such modifications are intended to fall within the scope of the appended claims.

What is claimed is:

1. A grinder roll assembly, comprising:

a grinder roll having a through bore defined by a surface of the grinder roll;

a shaft disposed within the through bore;

a first tapered sleeve disposed between the shaft and the grinder roll surface such that a first end of the first tapered sleeve is proximate to a first end of the through bore, wherein the first end of the first tapered sleeve has a first thickness and a first locking ring flange extending therefrom, and a second end of the first tapered sleeve has a second thickness greater than the first thickness;

a second tapered sleeve disposed between the shaft and the grinder roll surface such that a first end of the second tapered sleeve is proximate to the first end of the through bore, wherein the first end of the second tapered sleeve has a first thickness and a second locking ring flange extending therefrom, and a second end of the second tapered sleeve has a second thickness less than the first thickness;

at least one connector for fastening together the first and the second locking ring flanges to thereby form a first friction lock between the first tapered sleeve and the second tapered sleeve, a second friction lock between the grinder roll and one of the first tapered sleeve and the second tapered sleeve, and a third friction lock between the shaft and the other one of the first tapered sleeve and the second tapered sleeve.

2. The grinder roll assembly of claim 1, wherein the grinder roll assembly is for use in a grinder operative to pulverize into smaller particles clinkers that are produced by a coal-fired furnace.

3. The grinder roll assembly of claim 1, wherein the at least one connector functions to fasten together the first and the second locking ring flanges so as to apply a force to the second tapered sleeve, this applied force causing one of the first and the second tapered sleeves to move against the other of the first and the second tapered sleeves.

4. The grinder roll assembly of claim 1, wherein the at least one connector includes a fastener having member with a threaded portion;

one of the first and the second locking ring flanges includes a threaded portion configured for coupling to the threaded portion of the fastener member; and the other of the first and the second locking ring flanges includes an opening configured such that the threaded portion of the fastener member is passable through the opening in the other locking ring flange in order to couple the threaded portion of the fastener member to the threaded portion of the one locking ring flange.

5. The grinder roll assembly of claim 1, further comprising:

a third tapered sleeve disposed between the shaft and the grinder roll surface such that a first end of the third tapered sleeve is proximate to a second end of the through bore distal to the first end of the through bore, wherein the first end of the third tapered sleeve has a third thickness and a second end of the third tapered sleeve has a fourth thickness greater than the third thickness; and a fourth tapered sleeve disposed between the shaft and the grinder roll surface such that a fourth friction lock between the third tapered sleeve and the fourth tapered sleeve, a fifth friction lock between the grinder roll and one of the third tapered sleeve and the fourth tapered sleeve, and a sixth friction lock between the shaft and the other one of the third tapered sleeve and the fourth tapered sleeve, are formed.

6. The grinder roll assembly of claim 5, wherein (i) the first end of the third tapered sleeve has a third locking ring flange extending therefrom, (ii) a first end of the fourth tapered sleeve is proximate to the second end of the through bore, has a first thickness, and has a second locking ring flange extending therefrom, and (iii) a second end of the fourth tapered sleeve has a second thickness less than the first thickness, and further comprising:

at least one other connector for fastening together the third and the fourth locking ring flanges to thereby form the fourth, the fifth and the sixth friction locks;

wherein the at least one other connector functions to fasten together the third and the fourth locking ring flanges so as to apply a force to the fourth tapered sleeve, this applied force causing the fourth tapered sleeve to move against the third tapered sleeve.

7. The grinder roll assembly of claim 5, further comprising:

at least one other connector including a fastener having a member with a threaded portion; and one of the third and the fourth locking ring flanges includes a threaded portion configured for coupling to the threaded portion of the fastener member; and the other of the third and the fourth locking ring flanges includes an opening configured such that the threaded portion of the fastener member is passable through the opening in the other of the third and the fourth locking ring flanges in order to couple the threaded portion of the fastener member to the threaded portion of the one of the third and the forth locking ring flanges.

8. A locking mechanism for a grinder roll assembly including a grinder roll having a through bore defined by a surface of the grinder roll and a shaft disposed within the through bore, comprising:

a first tapered sleeve adapted to be disposed between the shaft and the grinder roll surface such that a first end of the first tapered sleeve is proximate to a first end of the through bore, wherein the first end of the first tapered sleeve has a first thickness and a first locking ring flange extending therefrom, and a second end of the first tapered sleeve has a second thickness greater than the first thickness;

a second tapered sleeve adapted to be disposed over the shaft and into the through bore such that a first end of the second tapered sleeve is proximate to the first end of the through bore, wherein the first end of the second tapered sleeve has a first thickness and a second locking ring flange extending therefrom, and a second end of the second tapered sleeve has a second thickness less than the first thickness; and at least one connector for fastening together the first and the second locking ring flanges to thereby form a first friction lock between the first tapered sleeve and the second tapered sleeve, a second friction lock between the grinder roll and one of the first tapered sleeve and the second tapered sleeve, and a third friction lock between the shaft and the other one of the first tapered sleeve and the second tapered sleeve.

9. The locking mechanism of claim 8, wherein the grinder roll assembly is for use in a grinder operative to pulverize into smaller particles clinkers that are produced by a coal-fired furnace.

10. The locking mechanism of claim 8, wherein the at least one connector functions to fasten together the first and the second locking ring flanges so as to apply a force to the second tapered sleeve causing the second tapered sleeve to move against the first tapered sleeve when the first tapered sleeve is disposed over the shaft and in contact with the second tapered sleeve.

11. The locking mechanism of claim 8, wherein:

the at least one connector includes a fastener having a member with a threaded portion;

one of the first and the second locking ring flanges includes a threaded portion configured for coupling to the threaded portion of the fastener; and the other of the first and the second locking ring flanges includes an opening configured such that the threaded portion of the fastener member is passable through the opening in the other locking ring flange in order to couple the threaded portion of the fastener member to the threaded portion of the one locking ring flange.

12. The locking mechanism of claim 8, further comprising:

a third tapered sleeve adapted to be disposed between the shaft and the grinder roll surface such that a first end of the third tapered sleeve is proximate to a second end of the through bore distal to the first end of the through bore, wherein the first end of the third tapered sleeve has a third thickness and a second end of the third tapered sleeve has a fourth thickness greater than the third thickness; and a fourth tapered sleeve adapted to be disposed over the shaft and into the through bore such that a fourth friction lock between the third tapered sleeve and the fourth tapered sleeve, a fifth friction lock between the grinder roll and one of the third tapered sleeve and the fourth tapered sleeve, and a sixth friction lock between the shaft and the other one of the third tapered sleeve and the fourth tapered sleeve, are formed.

13. A method for locking a grinder roll having a through bore extending from a first end to an opposing second end of the grinder roll and a shaft disposed within the through bore, comprising:

inserting a first tapered sleeve over the shaft and into a first end of the through bore such that a first end of the first tapered sleeve is proximate to the first end of the grinder roll, wherein the first end of the first tapered sleeve has a first thickness and a first locking ring flange extending therefrom, and a second end of the first tapered sleeve end has a second thickness greater than the first thickness; and inserting a second tapered sleeve over the shaft and into the first end of the through bore such that a first end of the second tapered sleeve is proximate to the first end of the through bore, wherein the first end of the second tapered sleeve has a first thickness and a second locking ring flange extending therefrom, and a second end of the second tapered sleeve has a second thickness less than the first thickness; and fastening together the first and the second locking ring flanges to thereby form a first friction lock between the first tapered sleeve and the second tapered sleeve, a second friction lock between the grinder roll and one of the first tapered sleeve and the second tapered sleeve, and a third friction lock between the shaft and the other one of the first tapered sleeve and the second tapered sleeve.

14. The method of claim 13, wherein fastening together the first and the second locking ring flanges applies a force to move the second tapered sleeve against the first tapered sleeve.

15. The method of claim 13, wherein fastening together the first and the second locking ring flanges includes passing a threaded portion of a fastener through an opening in one of the first and the second locking ring flanges and bolting the threaded portion of the fastener into a threaded portion of the other of the first and the second locking ring flanges.

16. The method of claim 13, further comprising:

inserting a third tapered sleeve over the shaft and into a second end of the through bore distal to the first end of the through bore such that a first end of the third tapered sleeve is proximate to the second end of the grinder roll, wherein the first end of the third tapered sleeve has a third thickness and a second end of the third tapered sleeve has a fourth thickness greater than the third thickness; and inserting a fourth tapered sleeve over the shaft and into the second end of the through bore to form a fourth friction lock between the third tapered sleeve and the fourth tapered sleeve, a fifth friction lock between the grinder roll and one of the third tapered sleeve and the fourth tapered sleeve, and a sixth friction lock between the shaft and the other one of the third tapered sleeve and the fourth tapered sleeve.

17. The method of claim 16, wherein (i) the first end of the third tapered sleeve has a third locking ring flange extending therefrom, (ii) a first end of the fourth tapered sleeve is proximate to the second end of the through bore, has a first thickness, and has a second locking ring flange extending therefrom, and (iii) a second end of the fourth tapered sleeve has a second thickness less than the first thickness, and further comprising:

fastening together the third and the fourth locking ring flanges so as to apply another force to move the fourth tapered sleeve against the third tapered sleeve.

18. The method of claim 16, wherein (i) the first end of the third tapered sleeve has a third locking ring flange extending therefrom, (ii) a first end of the fourth tapered sleeve is proximate to the second end of the through bore, has a first thickness, and has a second locking ring flange extending therefrom, and (iii) a second end of the fourth tapered sleeve has a second thickness less than the first thickness, and further comprising:

fastening together the third and the fourth locking ring flanges by passing a threaded portion of a fastener through an opening in one of the third and the fourth locking ring flanges and bolting the threaded fastener into a threaded portion of the other of the third and the fourth locking ring flanges.

* * * * *